US008051616B2

(12) United States Patent
George

(10) Patent No.: US 8,051,616 B2
(45) Date of Patent: Nov. 8, 2011

(54) MOVABLE PARTITIONS, HEADER ASSEMBLIES FOR MOVABLE PARTITIONS, AND RELATED METHODS

(75) Inventor: Michael D. George, Kaysville, UT (US)

(73) Assignee: Won-Door Corporation, Salt Lake City, UT (US)

( * ) Notice: Subject to any disclaimer, the term of this patent is extended or adjusted under 35 U.S.C. 154(b) by 53 days.

(21) Appl. No.: 12/477,056

(22) Filed: Jun. 2, 2009

(65) Prior Publication Data

US 2010/0299889 A1 Dec. 2, 2010

(51) Int. Cl.
*E06B 3/00* (2006.01)
*E05D 15/06* (2006.01)

(52) U.S. Cl. .... 52/243.1; 52/238.1; 52/36.5; 160/196.1; 160/201; 160/214

(58) Field of Classification Search ..... 160/84.01, 160/199, 84.08, 84.04, 84.05, 126, 40, 196.1, 160/114, 182, 188, 194, 259–260, 197–216, 160/225, 238, 218; 52/238.1, 243, 241, 592.3, 52/785, 809, 811, 802, 806, 145, 243.1, 232, 52/64, 204.1, 36.1, 36.5, 36.6, 210–212, 52/716.8

See application file for complete search history.

(56) References Cited

U.S. PATENT DOCUMENTS 2,909,802 A * 10/1959 Gang et al. ..... 16/87 R
3,529,651 A * 9/1970 Bender ..... 160/183
3,685,235 A * 8/1972 Lang ..... 52/39
3,755,968 A * 9/1973 Williams ..... 49/489.1
4,133,364 A * 1/1979 Smart ..... 160/199
4,281,481 A 8/1981 Wendt
4,674,248 A 6/1987 Hall
5,167,575 A * 12/1992 MacDonald ..... 454/187
5,411,072 A 5/1995 Starck et al.
5,481,834 A * 1/1996 Kowalczyk et al. ..... 52/64
6,615,894 B1 9/2003 McKeon
7,478,663 B2 * 1/2009 Goodman et al. ..... 160/188
7,513,293 B2 * 4/2009 Goodman et al. ..... 160/188
7,740,046 B2 * 6/2010 Goodman et al. ..... 160/188
7,845,385 B2 * 12/2010 Goodman et al. ..... 160/188
7,845,386 B2 * 12/2010 Coleman et al. ..... 160/199
7,854,248 B2 * 12/2010 Coleman et al. ..... 160/118
2008/0023152 A1 * 1/2008 Goodman et al. ..... 160/84.02
2008/0209827 A1 * 9/2008 Webb ..... 52/220.7
2008/0264578 A1 * 10/2008 Goodman et al. ..... 160/202
2009/0120595 A1 * 5/2009 Goodman et al. ..... 160/371
2011/0024061 A1 * 2/2011 Bell et al. ..... 160/199
2011/0093095 A1 * 4/2011 Goodman et al. ..... 700/13

* cited by examiner

*Primary Examiner* — Jeanette Chapman
(74) *Attorney, Agent, or Firm* — TraskBritt

(57) ABSTRACT

A header assembly for a movable partition includes an overhead track and a header pan. The header pan is configured to extend from the overhead track to an adjoining structure. The header pan, the overhead track, or a combination of both may form a fire-resistant barrier extending from a wall of the adjoining structure to an opposing wall of the adjoining structure. Movable partition systems may include header assemblies. Methods of forming header assemblies include positioning a header pan proximate to an overhead track and extending the header pan between a first wall and a second wall to at least substantially occlude a section of space therebetween. Methods of installing a movable partition include securing an overhead track to an overhead support structure, securing a retainer clip to an adjoining structure, extending a header pan from the overhead track to the retainer clip, and suspending a partition from the track.

13 Claims, 6 Drawing Sheets

MOVABLE PARTITIONS, HEADER ASSEMBLIES FOR MOVABLE PARTITIONS, AND RELATED METHODS

TECHNICAL FIELD

Embodiments of the present invention are directed to header assemblies for movable partitions, movable partition assemblies including header assemblies, and methods of forming and installing movable partitions and header assemblies.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security and a fire barrier. In such a case, the partition barrier may be configured to automatically close upon the occurrence of a predetermined event such as the actuation of an associated alarm. For example, one or more accordion or similar folding-type partitions may be used as a security barrier, a fire barrier, or both a security and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other specified reason, the partition may be extended along an overhead track, which is often located above the door in a header assembly, until the partition extends a desired distance across the room.

In some applications, the header assembly may provide structural support for the overhead track, the movable partition, and a motor. In fire barrier applications, it may be necessary that the movable partition and the header assembly of the partition provide a fire barrier. Generally, a fire barrier system or assembly provides a barrier to fire, smoke, and heat. Thus, a fire barrier may retard or resist the deleterious effects of fire, smoke, and heat for a certain period of time. A number of standardized tests that test the effectiveness of fire barrier assemblies have been developed for use in the building industry. These are published, for example, in the Uniform Building Code (UBC), the International Building Code (IBC), and by the National Fire Protection Association (NFPA), UNDERWRITERS LABORATORIES® (UL), and the American Society for Testing and Materials (ASTM), among others. Various agencies test fire barriers using these standardized tests, and assign ratings to fire barriers that indicate their effectiveness at slowing the progress of a fire. Barrier testing agencies include Intertek Testing Services, UNDERWRITERS LABORATORIES®, Chiltern International Fire, Ltd., and Warrington Fire Research, among others. Ratings of fire barrier assemblies are generally provided in minutes, and typically vary from twenty minutes to 180 minutes. Examples of fire barrier assembly standards and testing methods can be found in UNDERWRITERS LABORATORIES® UL 10B document titled, "UL Standard for Safety Fire Tests of Door Assemblies.".

In order to provide a fire barrier, the header assembly along with the movable partition and surrounding walls must also provide some level of fire resistance in addition to the movable partition. Thus, when the partition is employed as a fire barrier, it is known to attach the movable partition to a header structure that is configured to provide resistance to fire. FIG. 1 illustrates a conventional example of a fire-resistant header assembly. The header assembly 10 is provided in a header recess 12 formed between two fire rated walls 14 which include an opening for the movable partition (not shown). The header assembly 10 includes rods 16 extending from a structural support 18 provided above the two fire rated walls 14. The rods 16 extend from the structural support 18 to a location proximate to an overhead track 20 provided for the movable partition. One or more layers of plywood 22 are attached to the rods 16 extending from the support structure 18. The layers of plywood 22 are typically custom fitted onsite during installation of the movable partition and extend longitudinally along the length of the movable partition and the overhead track 20. The layers of plywood 22 also extend laterally across the header recess 12 to the two fire rated walls 14. One or more layers of gypsum board 24 are provided between the overhead track 20 and the layers of plywood 22. The layers of gypsum board 24 also extend longitudinally along the length of the movable partition and the overhead track 20 and extend laterally across the header recess 12 to the two fire rated walls 14. Some of the layers of gypsum board 24 extend only partially across the header recess 12 in a lateral direction in order to provide a pocket for the overhead track 20. That is, some layers of gypsum board 24 extend longitudinally along a lateral side of the overhead track 20 and extend laterally between a lateral side of the overhead track 20 and one of the two fire rated walls 14. The layers of gypsum board 24 (together with the layers of plywood 22 and the overhead track 20) provide a fire-resistant barrier extending across the header recess 12.

BRIEF SUMMARY

In accordance with some embodiments of the present invention, a header assembly for a movable partition may include an overhead track and a metal header pan at least partially abutting a portion of the overhead track. At least one of the overhead track and the metal header pan is configured to form a fire-resistant barrier extending from a wall of an adjoining structure to an opposing wall of the adjoining structure. At least one fastener element is configured to attach the overhead track to the adjoining structure.

Additionally, the header assembly may include at least one retainer clip configured to attach to at least one wall of the adjoining structure. Further, the metal header pan may extend laterally from at least a portion of the overhead track to a portion of the at least one retainer clip.

In additional embodiments, the present invention includes a movable partition system including a header assembly having a longitudinal axis. The header assembly includes at least one elongated first structural element extending in a direction substantially parallel to the longitudinal axis of the header assembly, at least one fastener element configured to couple the at least one structural element to a portion of a header structure, an elongated overhead track extending in a direction substantially parallel to the longitudinal axis of the header assembly and coupled to the at least one first structural element, and an elongated metal header pan at least partially abutting a portion of the overhead track. The metal header pan extends in a first direction substantially parallel to the longitudinal axis of the header assembly and is configured to extend in a second direction substantially perpendicular to the longitudinal axis of the header assembly toward at least a portion of at least one wall of the header structure. Further, the movable partition assembly includes a pleated structure having a plurality of hingedly coupled panels suspending from the overhead track.

In yet additional embodiments, the present invention includes a method of forming a fire-resistant header assembly for a movable partition. The method includes positioning an overhead track within a longitudinally extending space between a first wall and a second wall. The metal header pan is positioned proximate to the overhead track and is configured to extend in a lateral direction across the longitudinally extending space between the first wall and the second wall. Further, the metal header pan may at least substantially occlude a longitudinal section of the space between the first wall and the second wall.

In yet additional embodiments, the present invention includes a method of installing a movable partition. The method includes securing an overhead track to an overhead support member, securing at least one retainer clip to the at least one wall of the adjoining structure, extending a header pan from the overhead track to the at least one retainer clip, and suspending a movable partition from the overhead track

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the description of embodiments of the invention when read in conjunction with the accompanying drawings, in which:

DETAILED DESCRIPTION

Illustrations presented herein are not meant to be actual views of any particular partition or header assembly, but are merely idealized representations which are employed to describe embodiments of the present invention. Additionally, elements common between figures may retain the same numerical designation.

Figure 2:
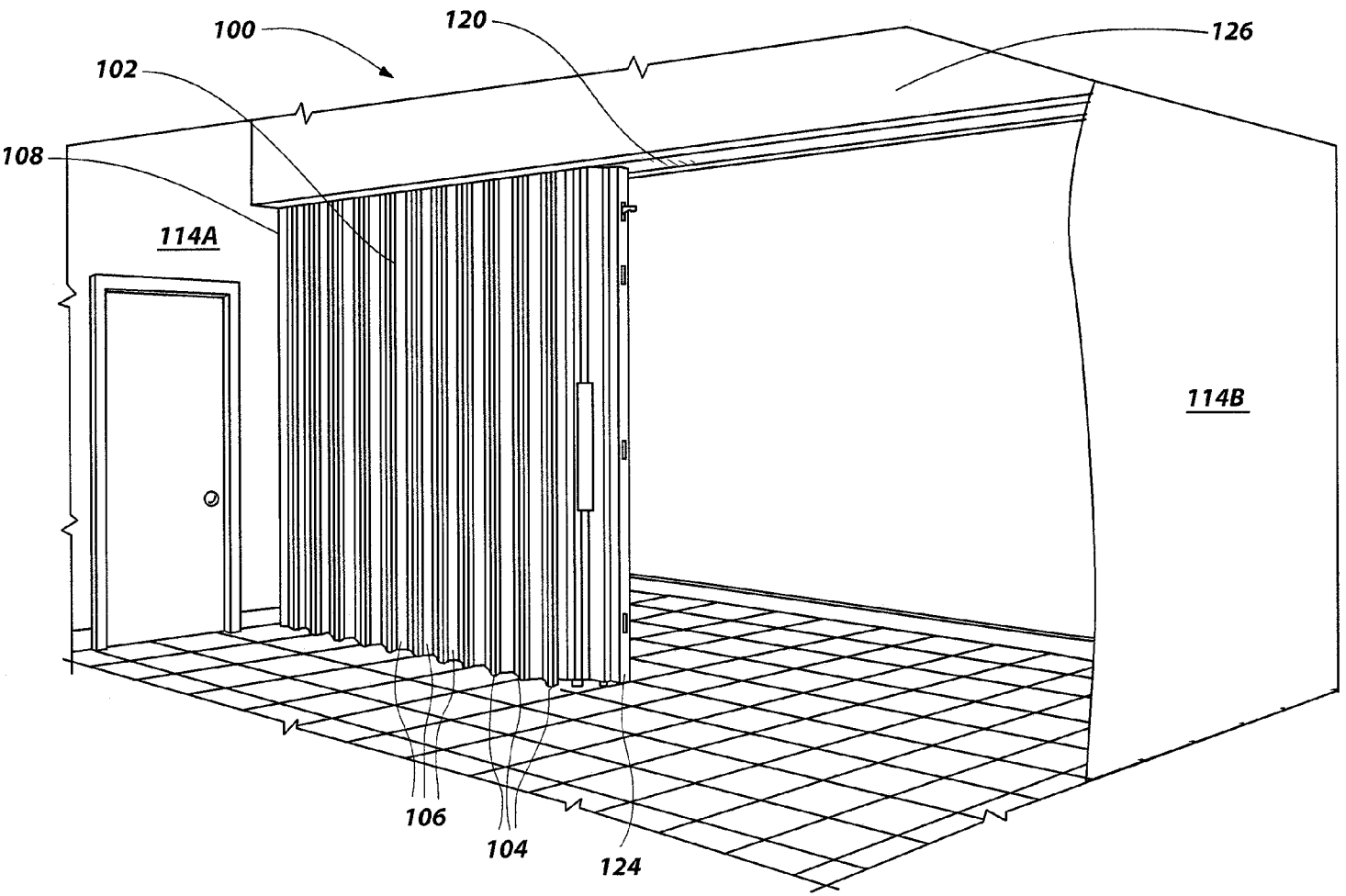
FIG. 2 is a perspective view of an embodiment of a movable partition system of the present invention.

Referring to FIG. 2, a system 100 is shown, which may also be referred to as a movable partition system 100, including a movable partition 102 in the form of an accordion-type door. The movable partition 102 may be used as a barrier (e.g., a security barrier and/or a fire barrier). As used herein, the term "fire barrier" or "fire resistant" means any material, structure, or element configured to provide a barrier to fire, smoke, and/or heat or configured to retard or resist the deleterious effects of fire, smoke, and/or heat for a certain period of time. In other embodiments, the movable partition 102 may be used, for example, to subdivide a relatively larger space into relatively smaller spaces (e.g., rooms or areas). The movable partition 102 may be formed with a plurality of panels 104 that are connected to one another with hinges or other hinge-like members 106 to form a pleated (i.e., plicated) structure. The movable partition 102 is engaged with (e.g., suspended from) an overhead track 120 along which the movable partition 102 moves as the movable partition 102 is expanded (i.e., closed) and retracted (i.e., opened). The hinged connection of the panels 104 allows the movable partition 102 to be compactly stored in a pocket 108 formed in a wall 114A of a building when in a retracted or folded state.

To deploy the movable partition 102 to an extended position, the movable partition 102 is moved along the overhead track 120. A leading edge of the movable partition 102 may include a lead post 124 configured to engage with a door jamb or another post, which may be provided in a wall 114B of a building to which the movable partition 102 may extend in an extended state. While the embodiment of the movable partition 102 shown and described with reference to FIG. 2 contains a single accordion-type door, additional embodiments of the present invention may include multiple doors. For example, a partition may include two doors (e.g., accordion-type doors) configured to extend across a space and join together to partition a space.

The system 100 also includes a header structure 126. The header structure 126 includes a structural support member and a header assembly, as discussed in further detail below. The movable partition 102 may be suspended from and supported by the header structure 126. In other embodiments, the movable partition 102 may be supported by the floor below the movable partition 102, and the header structure 126 may simply serve as a guide for the movable partition 102. While the embodiment of the header structure 126 shown and described with reference to FIG. 2 protrudes into the space where the movable partition 102 is located, the header structure 126 may be partially or entirely located in an overhead structure in additional embodiments. For example, the header structure 126 may not protrude into the space where the movable partition 102 is located, but rather, may be located in an overhead structure such that the overhead track 120 is mounted generally flush with the ceiling of the space.

Figure 1:
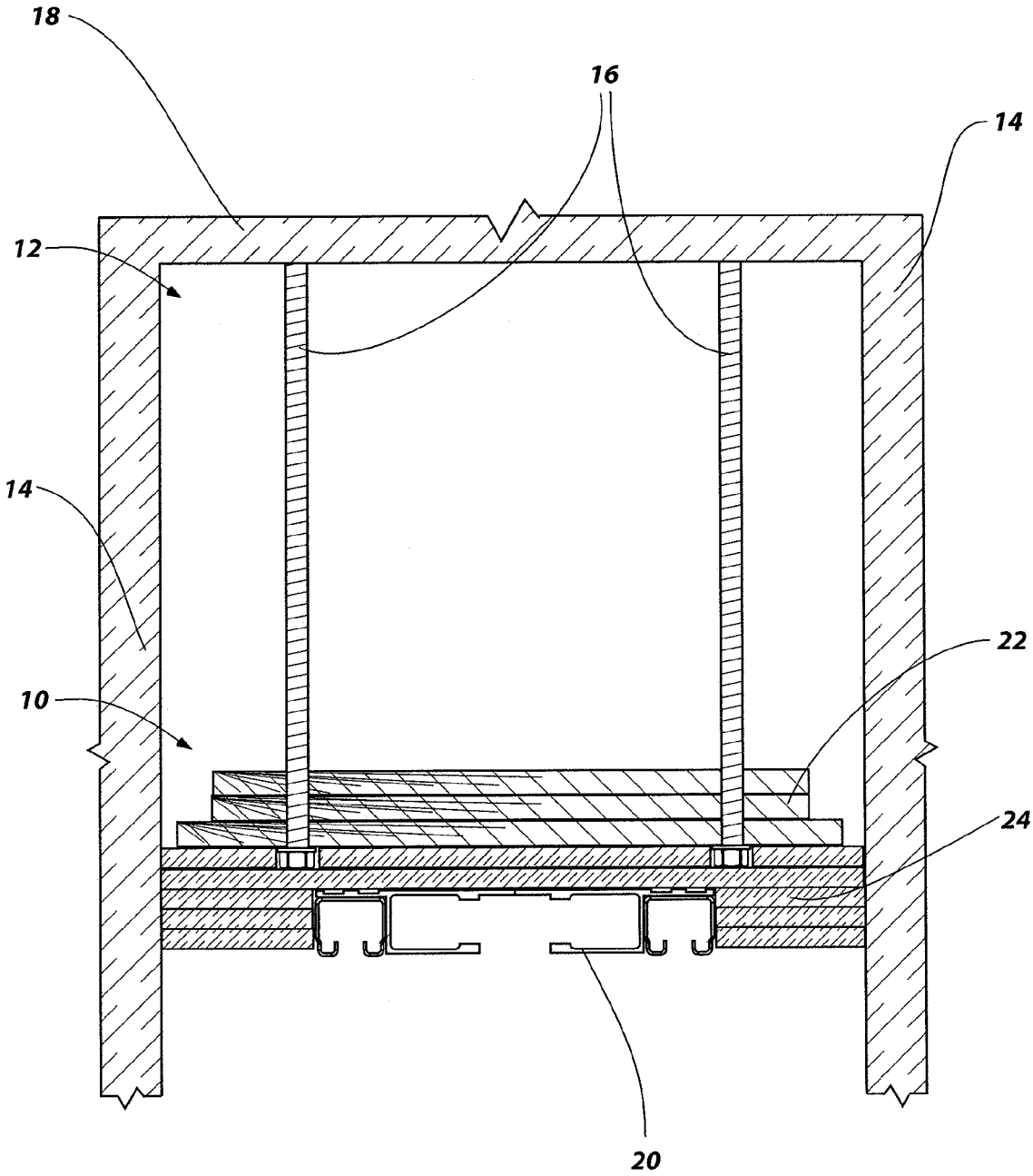
FIG. 1 Prior Art
FIG. 1 shows a partial cross-sectional view of a prior art header assembly for a movable partition.
Figure 3:
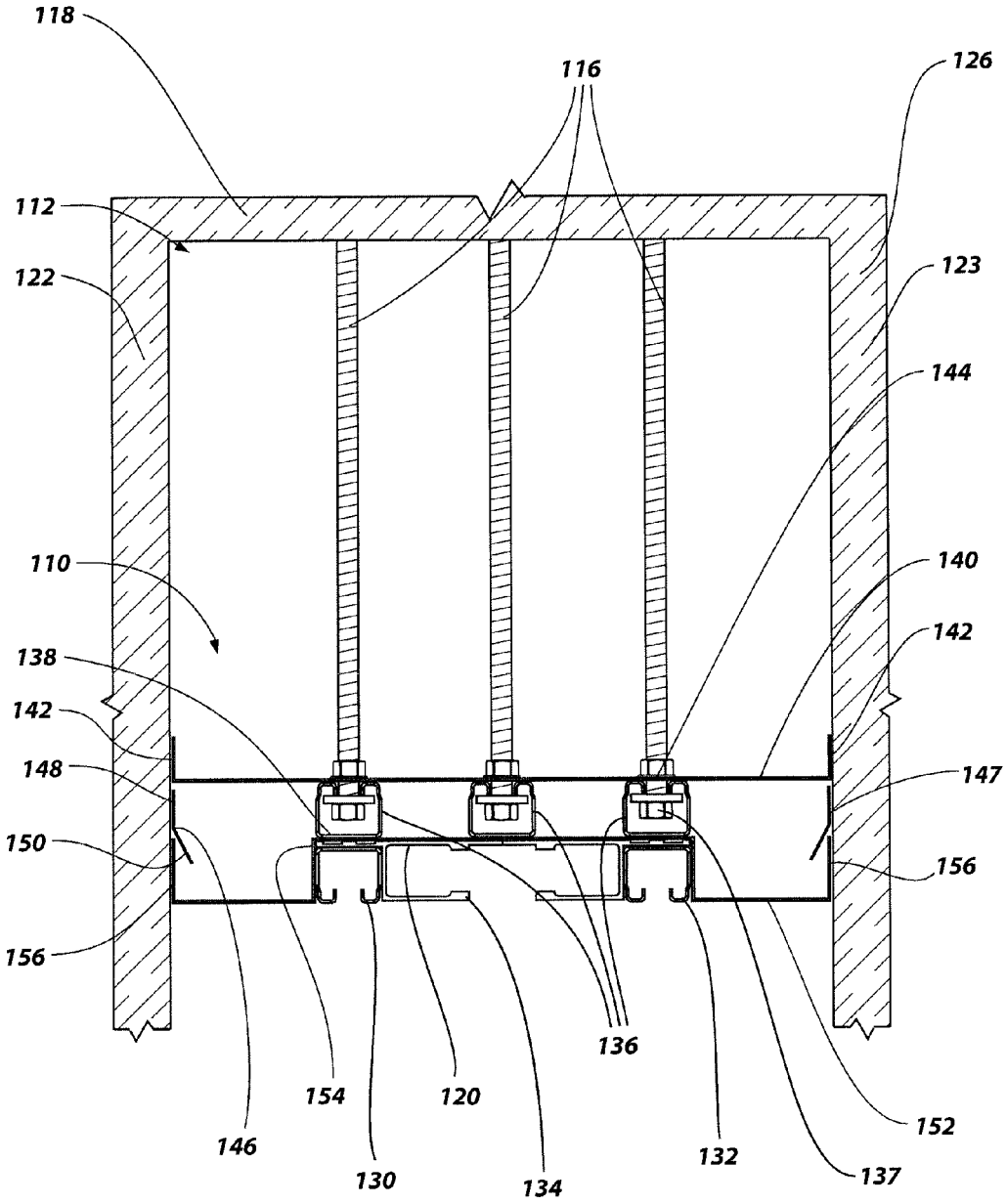
FIG. 3 shows a partial cross-sectional view of a header structure including a header assembly of the movable partition system shown in FIG. 2.

Referring to FIG. 3, the header structure 126 is shown in a partial cross-sectional view. As shown in FIG. 3, a header assembly 110 may be located at least partially within a header recess 112 in the header structure 126. The header recess 112 may be similar to the header recess 12 shown in FIG. 1 and may be provided between a first wall 122, a second wall 123, and an overhead support member 118. In some embodiments where the movable partition system 100 is implemented as a fire barrier, the first and second walls 122, 123, respectively may be formed from a fire-resistant material. It is noted that while the embodiment of FIG. 3 illustrates a header assembly 110 located within a header structure 126, the current invention is not so limited. The header assembly 126 may not be located in a header recess, but rather, may be located in any suitable location or may be mounted directly to an overhead support structure.

In some embodiments, the header assembly 110 for a movable partition 102 (FIG. 2) may include an overhead track 120. The overhead track 120 may include, for example, a first channel 130 and a second channel 132. The first channel 130 may be configured for receipt of slide mechanisms or rollers that may be attached to individual panels 104 (FIG. 2) associated with a first side of a movable partition 102, while a second channel 132 may be configured for receipt of similar slide mechanisms or rollers associated with individual panels 104 associated with a second side of the movable partition 102. The overhead track 120 may further include a central channel 134 that may be disposed between the two first and second channels 130 and 132. The central channel 134 may be configured for receipt of a trolley therein, and may provide a raceway for a belt or chain.

The overhead track 120 may be attached to an overhead support member 118 by fastener elements such as rods 116. One end of each of the rods 116 may be attached to the overhead support member 118. Each rod 116 may comprise a threaded rod that extends through the overhead support member 118, and a nut 137 may be threaded onto the end of the overhead support member 118 on a side thereof opposite the overhead track 120 to retain the rod 116 in position relative to the overhead support member 118. The overhead support member 118 may be, for example, a wood or metal beam, a truss structure, floor joists, etc.

The overhead track 120 is coupled to (directly or indirectly) and suspended from the rods 116. As shown in FIG. 3, the overhead track 120 may be indirectly coupled to the rods 116 using structural elements 136. The ends of the rods 116 opposite the overhead support member 118 may extend through a portion of the structural elements 136, and nuts 137 may be used to retain the structural elements 136 on the rods 116. The structural elements 136 may take the form of any of a number of well known and commercially available structural building and framing components. In some embodiments, the structural elements 136 may comprise elongated, substantially rectangular frame members having a channel 138 formed therein. By the way of example and not limitation, the rods 116, the structural elements 136, and the nuts 137 may comprise components of a metal framing system commercially available from the UNISTRUT® Corporation of Wayne, Mich. The structural elements 136 may extend in sections or continuously along the length of the overhead track 120 to support the overhead track 120 and the movable partition 102 (FIG. 2).

In some embodiments, the rods 116 may be threaded and may be anchored to an overhead support member 118. The rods 116 extend from the overhead support member 118 to the structural elements 136 and may be coupled thereto. The rods 116 may be coupled or fastened to the overhead support member 118 by any suitable manner such as, for example, using conventional nuts. In some embodiments, the rods 116 may be located at set distances along the overhead track 120 to attach the structural elements 136 to the overhead support member 118. For example, the rods 116 may be spaced at set intervals along the overhead track 120, each interval being spaced a set distance such as 18 inches (45.72 centimeters) apart. Further, in some embodiments, when the movable partition 102 is retracted (i.e., opened), the weight of the movable partition 102 will be concentrated in the area of the overhead track 120 located above the retracted movable partition 102 (e.g., the section of the overhead track 120 located in the pocket 108). Therefore, the rods 116 may be spaced at shorter intervals such as 12 inches (30.48 centimeters) in the area where the movable partition 102 is stored in a retracted state. It is noted that while the structural elements 136 of FIG. 3 are shown suspended from the overhead support member 118 by the rods 116, the structural elements 136 may be attached, suspended, or spaced from the overhead support member 118 by any suitable manner including, but not limited to, attaching the structural elements 136 directly to the overhead support member 118.

Figure 5:
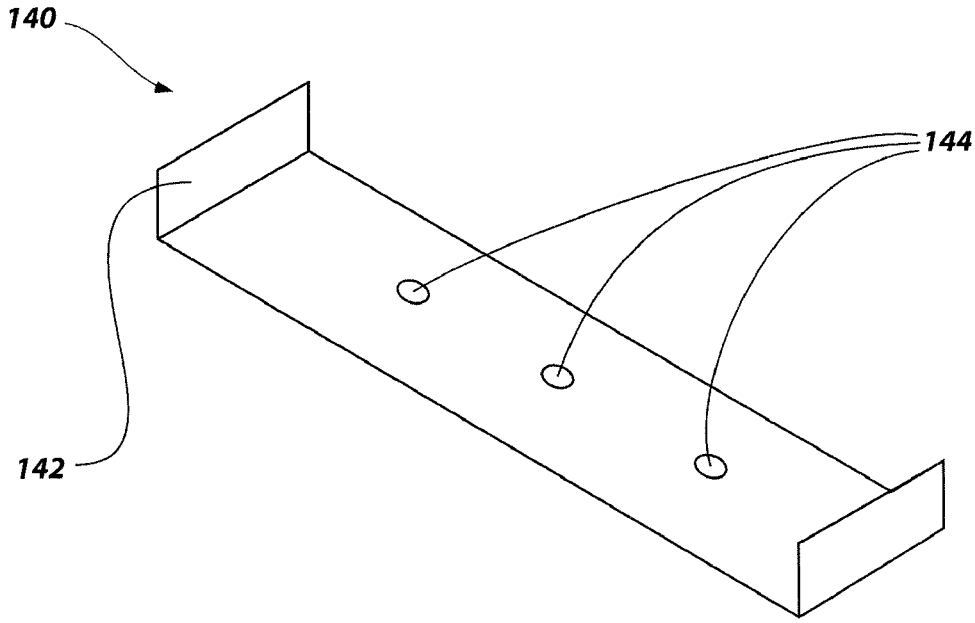
FIG. 5 is a perspective view of an embodiment of a cross brace for the header assembly shown in FIG. 3.

As shown in FIG. 3, in some embodiments, the header assembly 110 may further include a cross brace 140. The cross brace 140 may be sized and configured to maintain the ends of the rods 116 remote from the overhead support member 118 in an intended position. In other words, the rods 116 may be susceptible to lateral deflection, and the cross brace 140 may be used to prevent the rods 116 from deflecting laterally in any significant manner. In some embodiments, the cross brace 140 may extend across the header recess 112 from the first wall 122 to the second wall 123, such that the cross brace abuts against each of the first wall 122 and the second wall 123. The cross brace 140 is shown in further detail in FIG. 5. As shown in FIGS. 3 and 5, the cross brace 140 may include vertically extending flanges 142 positioned on the sides of the cross brace 140. The flange 142 on one side of the cross brace 140 may abut against the first wall 122, and the flange 142 on an opposite side of the cross brace 140 may abut against the second wall 123. Thus, the flanges 142 may be used to secure the cross brace 140 in position against the walls 122, 123 of the header structure 126. The cross brace 140 may further include holes 144 formed therein, and the rods 116 may extend through the holes 144. The cross brace 140 may be retained on the rods 116 by the structural elements 136 and the nuts 137.

The header assembly 110 may include a barrier member that extends across the recess 112 between the first wall 122 and the second wall 123. The barrier member may at least substantially seal off the header recess 112, if present. In some embodiments, the barrier member may comprise a fire-resistant barrier member. As an example, the barrier member may comprise a metal header pan 152. The header pan 152 may comprise one or more metal members (e.g., sheet metal members) that together form a metal pan that extends between the first wall 122 and the second wall 123 over the movable partition 102 (FIG. 2). The header pan 152 may be coupled or attached to the overhead track 120, and the header pan 152 and the overhead track 120 may be attached to the structural elements 136 using, for example, sheet metal screws.

In some embodiments, the header pan 152 may be formed to provide a channel 154 located, for example, in a central portion of the header pan 152, such that the header pan 152 extends over or at least partially around the overhead track 120. The overhead track 120 may be at least partially received within the channel 154 formed by the header pan 152. While the header pan 152 shown in FIG. 3 includes a channel 154, the header pan 152 may not include a channel. For example, the header pan may be substantially flat or the header pan may not extend partially around the overhead track 120, but rather, may simply be disposed adjacent to and coupled to a portion of the overhead track 120. The header pan 152 also may comprise flanges 156 for abutting against the first and second walls 122, 123, like the flanges 142 of the cross brace 140 previously described herein.

Figure 6:
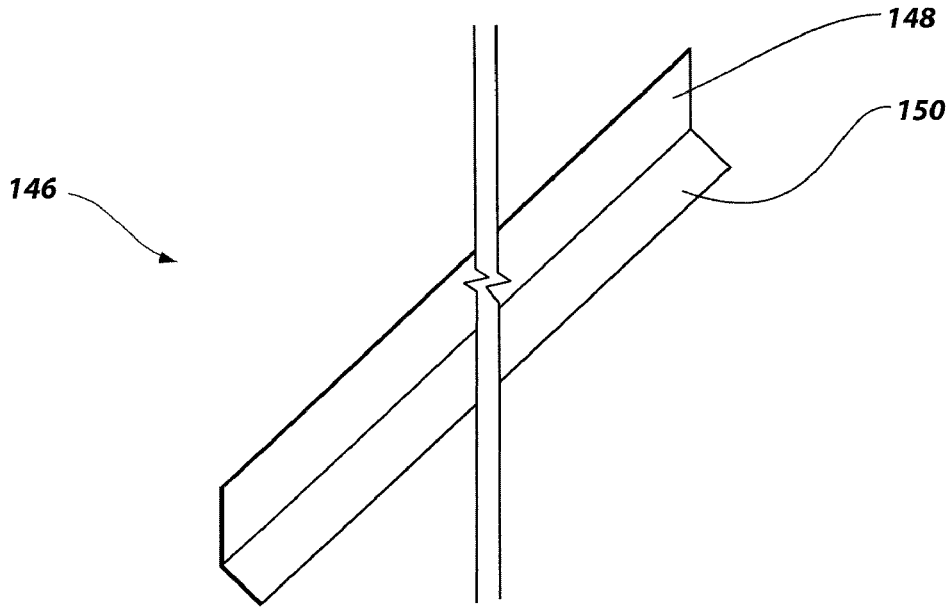
FIG. 6 is a perspective view of an embodiment of a retainer clip for the header assembly shown in FIG. 3.

In some embodiments, the header assembly 110 may further include a first retainer clip 146 attached to the first wall 122, and a second retainer clip 147 that is attached to the second wall 123. While the current embodiment shown and described in FIG. 3 includes first and second retainer clips 146, 147, the header assembly 110 may comprise one or a plurality of retainer clips. As shown in FIG. 3, the first and second retainer clips 146, 147 may be attached to, for example, a surface of the first and second walls 122, 123, respectively, defining the header recess 112. The first retainer clip 146 is shown in further detail in FIG. 6. It is noted that while the first retainer clip 146 is shown in detail in FIG. 6, the second retainer clip 147 may have substantially similar features as the first retainer clip 146. As shown in FIGS. 3 and 6, the first retainer clip 146 may include an attachment portion 148 and a receiving portion 150. The attachment portion 148 of the first retainer clip 146 may be attached to the header structure 126 (e.g., to the first wall 122) by any suitable means such as the use of adhesives or fasteners, or the first retainer clip 146 may comprise an integral part of the header structure 126 itself. The receiving portion 150 of the retainer clip 146 may extend away from a surface of the header structure 126 (e.g., from the first wall 122) as to create a recess between the receiving portion 150 and the surface of the header structure 126. The flanges 156 of the header pan 152 may be positioned within the recesses between the receiving portions 150 of the first and second retainer clips 146, 147 and the surfaces of the first and second walls 122, 123 to which the first and second retainer clips 146, 147 are respectively attached. The first and second retainer clips 146, 147 thus may be used to assist in positioning the header pan 152 at a selected location within the header recess 112 (as the first and second retainer clips 146, 147 will prevent the header pan 152 from being moved further into the header recess 112. The first and second retainer clips 146, 147 also may be used to improve the barrier or seal between the header pan 152 and the first and second walls 122, 123.

Thus described, a structural barrier (which may comprise a fire barrier) is formed by the various components of the header assembly 110.

Figure 4:
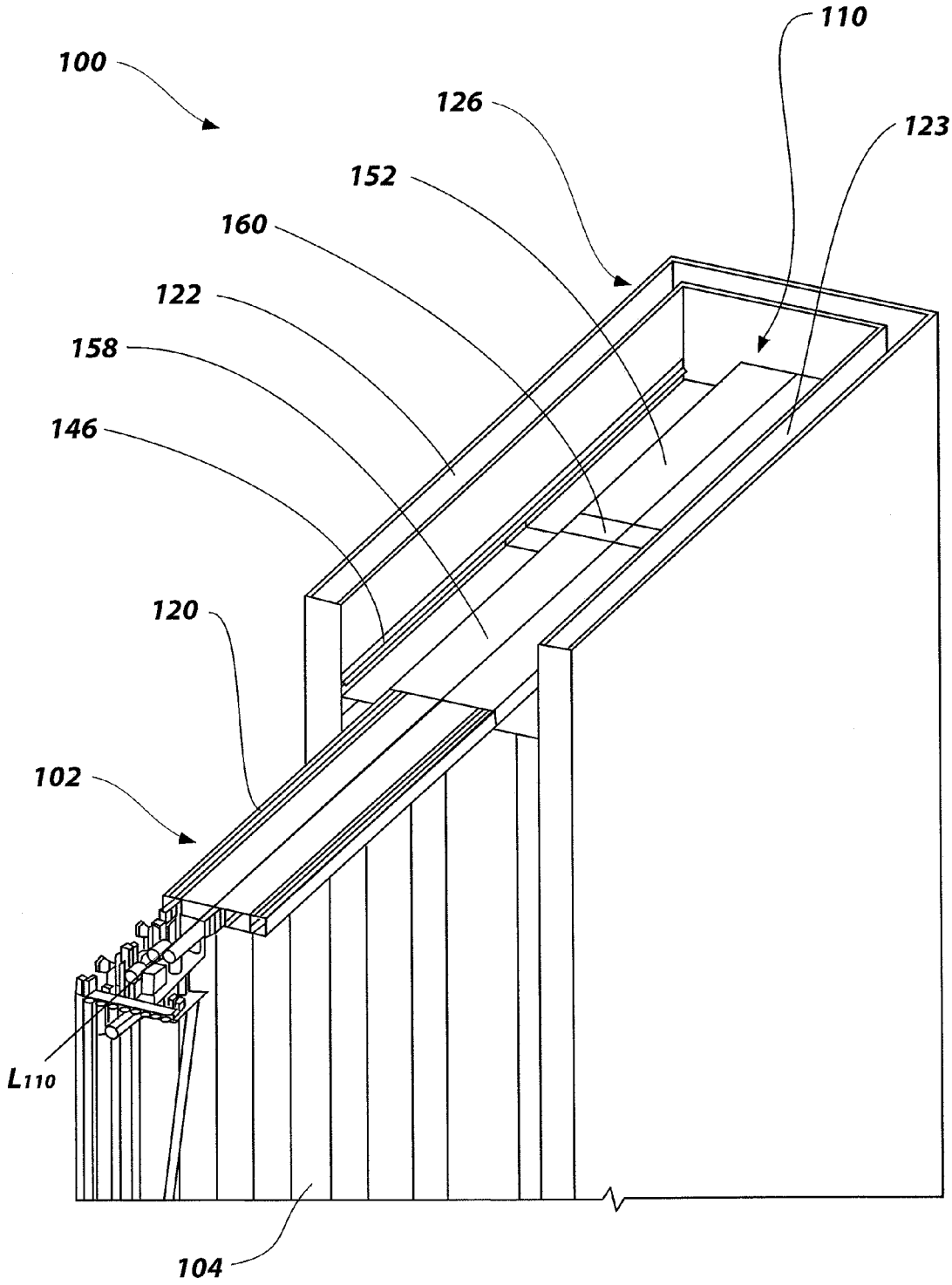
FIG. 4 is a perspective view of a movable partition system shown in FIGS. 2 and 3 with various components and sections stripped away to show certain details in accordance with an embodiment of the present invention.

FIG. 4 is a perspective view of the movable partition system 100 shown in FIGS. 2 and 3 with various components and sections stripped away to show certain details of the header assembly 110. As shown in FIG. 4, the movable partition system 100 may include a movable partition 102 including a plurality of panels 104 suspended by an overhead track 120. The system 100 may further include a header assembly 110 formed in a header structure 126 defined by the two walls 122, 123.

The header pan 152 may extend longitudinally along at least a portion of the overhead track 120. Further, the header pan 152 may also extend in a substantially lateral direction from at least a portion of the overhead track 120 to the first and second retainer clips 146, 147. By way of example and not limitation, the header assembly 110 may have a longitudinal axis $L_{110}$. The header pan 152 may extend longitudinally along a portion of the overhead track 120 along an axis substantially parallel to the longitudinal axis $L_{110}$. Referring now to FIGS. 3 and 4, the header pan 152 may extend laterally from a portion of the overhead track 120 toward the first and second retainer clips 146, 147 along an axis substantially perpendicular to the longitudinal axis $L_{110}$. In some embodiments, the lateral edge portions (e.g., the flanges 156) of the header pan 152 may be received within the recesses formed between the receiving portions 150 of the retainer clips 146, 147 and the surfaces of the walls 122, 123. Further, in certain embodiments, an edge of the header pan 152 may abut the retainer clips 146, 147. For example, an edge of header pan 152 may be received within the recesses defined by the receiving portion 150 of the surfaces of the first and second walls 122, 123.

In embodiments where the movable partition 102 is employed as a fire barrier, the header pan 152, the overhead track 120, and the first and second retainer clips 146, 147 may comprise a fire-resistant material such as steel, composite materials, or any material capable of exhibiting fire-resistant qualities over a set period of time or any material treated with a fire retardant coating.

Figure 7:
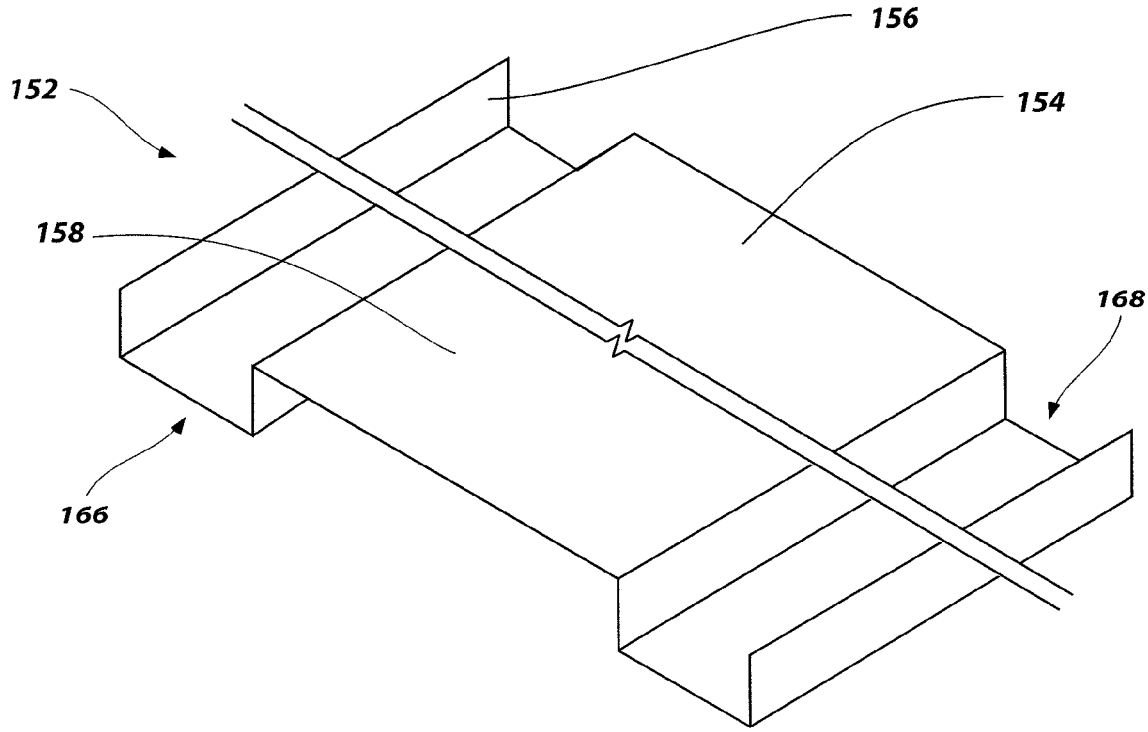
FIG. 7 is a perspective view of an embodiment of a header pan section for the header assembly shown in FIG. 3.
Figure 8:
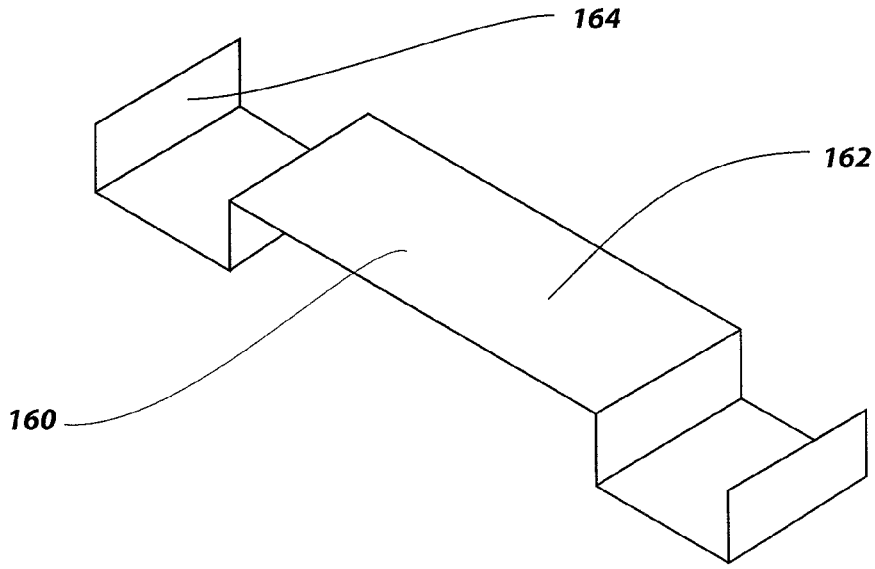
FIG. 8 is a perspective view of an embodiment of a header pan joint for the header assembly shown in FIG. 3.

Referring now to FIGS. 7 and 8, a header pan 152 including a channel 154 configured to receive the overhead track 120 (FIG. 2) is shown. As discussed above, the header pan 152 may include vertically oriented flanges 156 positioned on each of the lateral sides of the header pan 152. The flanges 156 may be at least partially received by, or abutted against, the first and second retainer clips 146, 147 (FIG. 6). As discussed above, the header pan 152 may also be formed as to provide a channel 154. The channel 154 may be formed as to at least partially receive the overhead track 120 therein. Referring to FIGS. 3 and 7, in some embodiments, the header pan 152 may include a first side portion 166 and a second side portion 168. The first side portion 166 of the header pan 152 may extend to a first retainer clip 146 and the second side portion 168 may extend to a second retainer clip 147.

Referring again to FIGS. 7 and 8, in some embodiments, the header pan 152 may comprise one header pan section 158. Alternatively, in some embodiments, the header pan 152 may comprise a plurality of header pan sections 158 and header pan joint members 160. The header pan sections 158 may abut against one another in an end-to-end configuration to provide a contiguous header pan 152 in the header assembly 110 (FIGS. 3 and 4). The header pan joint members 160 may be used to cover joints between abutting ends of the header pan sections 158.

As shown in FIG. 8, each header pan joint member 160 is formed to have substantially the same shape as the header pan sections 158 including a channel 162 and vertically oriented sections 164 positioned on the lateral sides of the header pan joint members 160. However, the header pan joint members 160 may be oversized or undersized with respect to the header pan sections 158 in order to fit between and at least partially overlap two adjacent header pan sections 158. As shown in FIG. 4, to form the contiguous header pan 152, the header pan sections 158 may be located adjacent each other. Seams between each header pan section 158 may be covered with a header pan joint member 160 and may be coupled together by any suitable manner including, for example, the use of fasteners, adhesives, crimping, or welding to form the contiguous header pan 152 structure.

As the various components of the header assembly 110 may be formed from a fire-resistant material such as steel, embodiments of header assemblies 110 of the present invention may be substantially free of gypsum board and other gypsum board-like materials typically used in fire rated walls and barriers.

Referring again to FIGS. 3 and 4, a method of forming a header assembly 110 (e.g., a fire-resistant header assembly 110) for a movable partition 102 as shown in the embodiments described above is now discussed. Forming the header assembly 110 may include abutting a metal header pan 152 to an overhead track 120. A barrier may be formed by configuring the header pan 152 to extend from the overhead track 120 to at least one wall of a header structure 126. In some embodiments, the header pan 152 may extend from the overhead track 120 to a first wall 122 of the header structure 126 and to an opposing, second wall 123 of the header structure 126. Further, an attachment feature such as the first and second retainer clips 146, 147 may be configured to couple to the at least one first wall 122 of a header structure 126. The first and second retainer clips 146, 147 may also abut an edge portion of the header pan 152. The header pan 152 may also be extended laterally from the overhead track 120 to the first and second retainer clips 146, 147 and may, in some embodiments, abut at least a portion of the first and second retainer clips 146, 147. In some embodiments, the overhead track 120 may be coupled to a structural element 136 and a rod 116 may be configured to attach the structural element 136 to the header structure 126. Further, the rod 116 may extend through a cross brace 140 extending from the first wall 122 of the header structure 126 to the second wall 123 of the header structure 126.

Referring still to FIGS. 3 and 4, a method of installing a fire-resistant movable partition is discussed. The method of installing a fire-resistant movable partition 102 may include securing an overhead track 120 to an adjoining structure such as the header structure 126, securing a first retainer clip 146 to a first wall 122 of the header structure 126, extending a portion of a header pan 152 from the overhead track 120 to the first retainer clip 146, and suspending a movable partition 102 from the overhead track 120. In some embodiments, a first retainer clip 146 may be secured to a side first wall 122 of the header structure 126 and a second retainer clip 147 may be secured to an opposing side second wall 123 of the header structure 126. The header pan 152 may extend laterally in a first direction to the first retainer clip 146 and may extend in a second direction to the second retainer clip 147. Additionally, in some embodiments, the header pan 152 and the first retainer clip 146 may be formed from a material comprising a fire-resistant material.

In view of the above, embodiments of the present invention may be particularly useful in providing a header assembly for a movable partition. Use of a simplified barrier such as the header pan and, in some applications, the retaining clips to provide a header assembly may allow for a simplified installation of a movable partition. Use of the cross brace may allow the header assembly to be aligned and secured within a header structure. The use of the header assembly allows for parts of the movable partition system to be pre-prepared before installation and reduces the need to customize parts and materials such as layers of plywood and gypsum board to fit each individual installation. Moreover, in applications where the movable partition is employed as a fire barrier, the header assembly provides an adaptable fire-resistant barrier.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A header assembly for a movable partition comprising:
an overhead track;
a metal header pan at least partially abutting a portion of the overhead track, wherein at least one of the overhead track and the metal header pan is configured to form a fire-resistant barrier extending from a wall of an adjoining structure to an opposing wall of the adjoining structure;
at least one fastener element configured to attach the overhead track to the adjoining structure; and
at least one retainer clip configured to attach to at least one wall of the adjoining structure, wherein the metal header pan extends laterally from at least a portion of the overhead track to a portion of the at least one retainer clip.

2. The header assembly of claim 1, further comprising at least one structural element coupling at least a portion of the overhead track to the at least one fastener element.

3. A header assembly for a movable partition comprising:
an overhead track;
a metal header pan at least partially abutting a portion of the overhead track, wherein at least one of the overhead track and the metal header pan is configured to form a fire-resistant barrier extending from a wall of a header structure to an opposing wall of the header structure;
at least one fastener element configured to attach the overhead track to the header structure;
at least one structural element coupling at least a portion of the overhead track to the at least one fastener element; and
a cross brace having at least one hole formed therein, the cross brace abutting at least a portion of the at least one structural element and extending from the wall of the header structure to the opposing wall of the header structure, and wherein the at least one fastener element extends through the at least one hole.

4. The header assembly of claim 1, wherein the at least one retainer clip comprises a first retainer clip and a second retainer clip, the first retainer clip configured to attach to the wall of the adjoining structure and the second retainer clip configured to attach to the opposing wall of the adjoining structure.

5. The header assembly of claim 4, wherein the metal header pan further comprises:
a central portion at least partially abutting the overhead track;
a first side portion extending in a first direction to the first retainer clip; and
a second side portion extending in a second direction to the second retainer clip.

6. The header assembly of claim 1, wherein a central portion of the metal header pan comprises a channel and wherein at least a portion of the overhead track is received in the channel.

7. The header assembly of claim 1, wherein the metal header pan comprises a plurality of header pan sections and at least one header pan joint, the header pan joint abutting at least one of the plurality of header pan sections to form a contiguous structure.

8. The header assembly of claim 1, wherein the at least one retainer clip further comprises a receiving portion configured to extend away from the at least one wall of the adjoining structure to form a recess, and wherein an edge portion of the metal header pan is received within the recess.

9. The header assembly of claim 2, wherein the at least one fastener element comprises a plurality of rods configured to attach to the adjoining structure and wherein at least one of the plurality of rods is coupled to the at least one structural element.

10. A movable partition system comprising:
a header assembly having a longitudinal axis, the header assembly comprising:
at least one elongated structural element extending in a direction substantially parallel to the longitudinal axis of the header assembly;
at least one fastener element configured to couple the at least one elongated structural element to a portion of a header structure;
an elongated overhead track extending in a direction substantially parallel to the longitudinal axis of the header assembly and coupled to the at least one elongated structural element by at least one fastener element; and an elongated metal header pan at least partially abutting a portion of the elongated overhead track, the metal header pan extending in a first direction substantially parallel to the longitudinal axis of the header assembly and configured to extend in a second direction substantially perpendicular to the longitudinal axis of the header assembly toward at least a portion of at least one wall of the header structure, wherein at least one of the elongated overhead track and the elongated metal header pan is configured to form a fire-resistant barrier extending from a wall of an adjoining structure to an opposing wall of the adjoining structure; and at least one elongated retainer clip extending in a direction substantially parallel to the longitudinal axis of the header assembly and configured to couple to the header structure, and wherein an edge of the elongated metal header pan extends in the second direction to the at least one elongated retainer clip; and a pleated structure having a plurality of hingedly coupled panels suspending from the elongated overhead track.

11. The movable partition system of claim 10, further comprising a cross brace having at least one hole formed therein, the cross brace abutting at least a portion of the at least one elongated structural element and wherein the at least one fastener element comprises a plurality of rods, at least one of the plurality of rods extending through the at least one hole formed in the cross brace.

12. A header assembly for a movable partition comprising:

at least one elongated structural element extending in a direction substantially parallel to a longitudinal axis of the header assembly;

at least one fastener element configured to couple the at least one elongated structural element to a portion of a header structure;

an elongated overhead track extending in a direction substantially parallel to the longitudinal axis of the header assembly and coupled to the at least one elongated structural element;

an elongated metal header pan at least partially abutting a portion of the elongated overhead track, the metal header pan configured to at least partially form a barrier by extending in a first direction substantially parallel to the longitudinal axis of the header assembly and configured to extend in a second direction substantially perpendicular to the longitudinal axis of the header assembly toward at least a portion of at least one wall of the header structure; and at least one elongated retainer clip extending in a direction substantially parallel to the longitudinal axis of the header assembly and configured to couple to the header structure and wherein an edge of the elongated metal header pan extends in the second direction to the at least one elongated retainer clip.

13. A header assembly for a movable partition, comprising:

at least one elongated structural element extending in a direction substantially parallel to a longitudinal axis of the header assembly;

at least one fastener element configured to couple the at least one elongated structural element to a portion of a header structure;

an elongated overhead track extending in a direction substantially parallel to the longitudinal axis of the header assembly and coupled to the at least one elongated structural element;

an elongated metal header pan at least partially abutting a portion of the elongated overhead track, the metal header pan configured to at least partially form a barrier by extending in a first direction substantially parallel to the longitudinal axis of the header assembly and configured to extend in a second direction substantially perpendicular to the longitudinal axis of the header assembly toward at least a portion of at least one wall of the header structure; and a cross brace having at least one hole formed therein, the cross brace abutting at least a portion of the at least one elongated structural element and wherein the at least one fastener element comprises a plurality of rods, at least one of the plurality of rods extending through the at least one hole formed in the cross brace.

* * * * *